United States Patent [19]

Prohaska

[11] 4,257,348

[45] Mar. 24, 1981

[54] DEVICE MEASURING THE CONCENTRATION OF TONER IN A DEVELOPER MIXTURE

[75] Inventor: Peter Prohaska, Nüremberg, Fed. Rep. of Germany

[73] Assignee: Hoechst Aktiengesellschaft, Frankfurt/Main, Fed. Rep. of Germany

[21] Appl. No.: 916,351

[22] Filed: Jun. 16, 1978

[30] Foreign Application Priority Data

Jun. 18, 1977 [DE] Fed. Rep. of Germany ..... 2727402

[51] Int. Cl.[3] ..... G03G 15/08; G03G 15/09

[52] U.S. Cl. ..... 118/689; 118/712; 324/236; 355/3 DD; 222/DIG. 1

[58] Field of Search ..... 118/7, 646, 712, 689, 118/690; 324/236; 355/3 DD; 222/DIG. 1

[56] References Cited

U.S. PATENT DOCUMENTS

| | | | |
|---|---|---|---|
| 2,547,407 | 4/1951 | Nelson | 324/239 |
| 3,094,049 | 6/1968 | Snelling | 118/689 |
| 3,504,276 | 3/1970 | Proctor et al. | 324/37 |
| 3,572,551 | 3/1971 | Gillespie et al. | 118/646 X |
| 3,588,687 | 6/1971 | Kohler | 324/243 |
| 3,892,672 | 7/1975 | Gawron | 324/236 X |
| 3,970,036 | 7/1976 | Baer et al. | 324/236 X |

FOREIGN PATENT DOCUMENTS 2746352 4/1978 Fed. Rep. of Germany .

*Primary Examiner*—Roland E. Martin, Jr.
*Attorney, Agent, or Firm*—Schwartz, Jeffery, Schwaab, Mack, Blumenthal & Koch

[57] ABSTRACT

Disclosed is a device for measuring the concentration of toner in a developer mixture composed of toner and a ferromagnetic carrier material, e.g., in an electro-photographic developing device. The device comprises a measuring oscillator which comprises an inductance-including component comprising at least one coil wherein the conductor paths of the coil lie substantially in one plane; means for passing at least a portion of the developer mixture into the zone of the inductance; and means for evaluating changes in the frequency of the oscillator resulting from changes in the developer mixture composition passing over the zone of inductance. Also disclosed is an electro-photographic copying apparatus embodying the foregoing device.

10 Claims, 8 Drawing Figures

DEVICE MEASURING THE CONCENTRATION OF TONER IN A DEVELOPER MIXTURE

BACKGROUND OF THE INVENTION

The invention relates to a device for measuring the concentration of toner in a developer mixture, particularly in an electro-photographic copying apparatus wherein the developer consists of toner and a ferromagnetic carrier material. More especially, the measuring device has a component which is part of a measuring oscillator and carries an inductance, and into the zone of inductance is passed at least a part of the developer mixture, which is to have the change in its toner concentration measured.

In known copying machines, in which the latent electrostatic images on the surface of a photo-conductive layer are developed with the aid of a developer mixture consisting of toner and a ferromagnetic carrier material, only the toner particles are consumed, whereas the ferromagnetic carrier material remains and can be reused. It is therefore necessary to replenish the developer mixture periodically or continuously by replacing the consumed toner so that the concentration of the toner in the developer mixture is kept at a predetermined value within close tolerances, in order to achieve a desired density of the developed copies. If the concentration of toner in the developer mixture is lower than the optimum concentration, the density of the developed copy becomes inadequate, and if, on the other hand, the concentration of toner is too high, copies with an undesirable background result.

German Offenlegungsschrift No. 2,014,430 discloses a device of the type initially set forth for monitoring and controlling the concentration of toner in a developer mixture. In this device samples of the developer mixture are taken past the windings of a coil which is located in a circuit which carries an a.c. voltage. The output signals of the circuit depend on the inductance of the coil and hence on the concentration of toner in the samples of the developer mixture. There is also provided an assembly for determining the concentration of toner, which assembly is coupled to the circuit carrying the a.c. voltage and responds to the output signals. The arrangement for taking the samples of the developer mixture past the windings of the coil is a sample tube which consists of non-magnetic material and leads through the coil.

The system, described in German Offenlegungsschrift No. 2,525,952, for monitoring the concentration of toner in a developer is constructed in a similar manner and has a channel with an inlet and outlet orifice through which the developer is to be fed and a measuring coil which at least partially surrounds the channel and is connected to measuring instruments for measuring the changes of inductance in the measuring coil as a measure of the change in the concentration of toner in the developer.

German Offenlegungsschrift No. 1,936,815 relates to a device for measuring the concentration of toner in a developer mixture, consisting of a coil having a ferromagnetic core which, together with a part of the developer mixture, forms a magnetic circuit of the coil. The coil and its magnetic circuit form an inductance, the change of which influences the output frequency of an oscillating circuit so that any change in the permeability of the developer mixture results in a change in frequency. The core of the coil is in contact with the outside of the wall of the developer container which must consist of a non-magnetic material, at least in this zone, so that the magnetic field can penetrate through the wall into the developer container and the magnetic circuit of the coil is closed via that part of the developer mixture which is opposite the core.

The common feature of these known devices for measuring the concentration of toner is that the leakage inductances used reach partially into the zone of the developer mixture and that only samples of the developer mixture are covered. These are statistical measurements which do not establish with certainty whether the measured value is representative for the average of the concentration of toner in the developer mixture. A further disadvantage is that the coils used have a certain overall height which permits installation only at certain points of the copying machine and that the small internal diameter of the coils, or the tubes which lead through the coils, give rise to blockages with developer mixture, so that frequent cleaning becomes necessary.

SUMMARY OF THE INVENTION

It is therefore an object of the invention to provide an improved device for measuring the toner concentration in a developer mixture.

Another object of the invention resides in providing such a device for use in an electro-photographic copying apparatus.

It is another object of the invention to provide such a device wherein a component is provided, having an inductance which is adapted to very confined space conditions in the copying machine and which can be located directly in the developer mixture which flows back from the photo-conductive layer into the developer container, in order to be able to determine, with high accuracy, a representative average of the concentration of toner.

In accomplishing the foregoing objects, there has been provided in accordance with one aspect of the present invention a device for measuring the concentration of toner in a developer mixture composed of toner and a ferromagnetic carrier material, this device being adapted for installation in an electro-photographic developing device and comprising: a measuring oscillator which comprises an inductance-including component comprising at least one coil wherein the conductor paths of the coil lie substantially in one plane; means for passing at least a portion of the developer mixture into the zone of the inductance; and means for evaluating changes in the frequency of the oscillator resulting from changes in the developer mixture composition passing over the zone of inductance. Preferably, the passing means includes a cylinder for applying the developer mixture to a photo-conductive surface of a drum mounted above the cylinder, and the coil(s) rest upon a deflection plate extending tangentially and at an inclination with respect to the cylinder.

In accordance with another aspect, there has been provided according to the invention, an electro-photographic copying apparatus, comprising a compartment containing a developer mixture comprised of a toner and a ferromagnetic carrier matter, the toner concentration measuring device as defined above positioned in the compartment, and means for replenishing toner to the developer mixture in response to a signal emitted by the measuring device.

FIGS. *2a*, *2b* and *2c* are schematic views of components which have an inductance and which are parts of the device according to the invention for measuring the concentration of toner in the developer mixture;

FIG. *2d* is a cross-sectional view of a further component having an inductance and comprising a part of the device according to the invention for measuring the concentration of toner in the developer mixture;

FIG. *2e* is a schematic top view of FIG. *2d*; and

Figure 3:
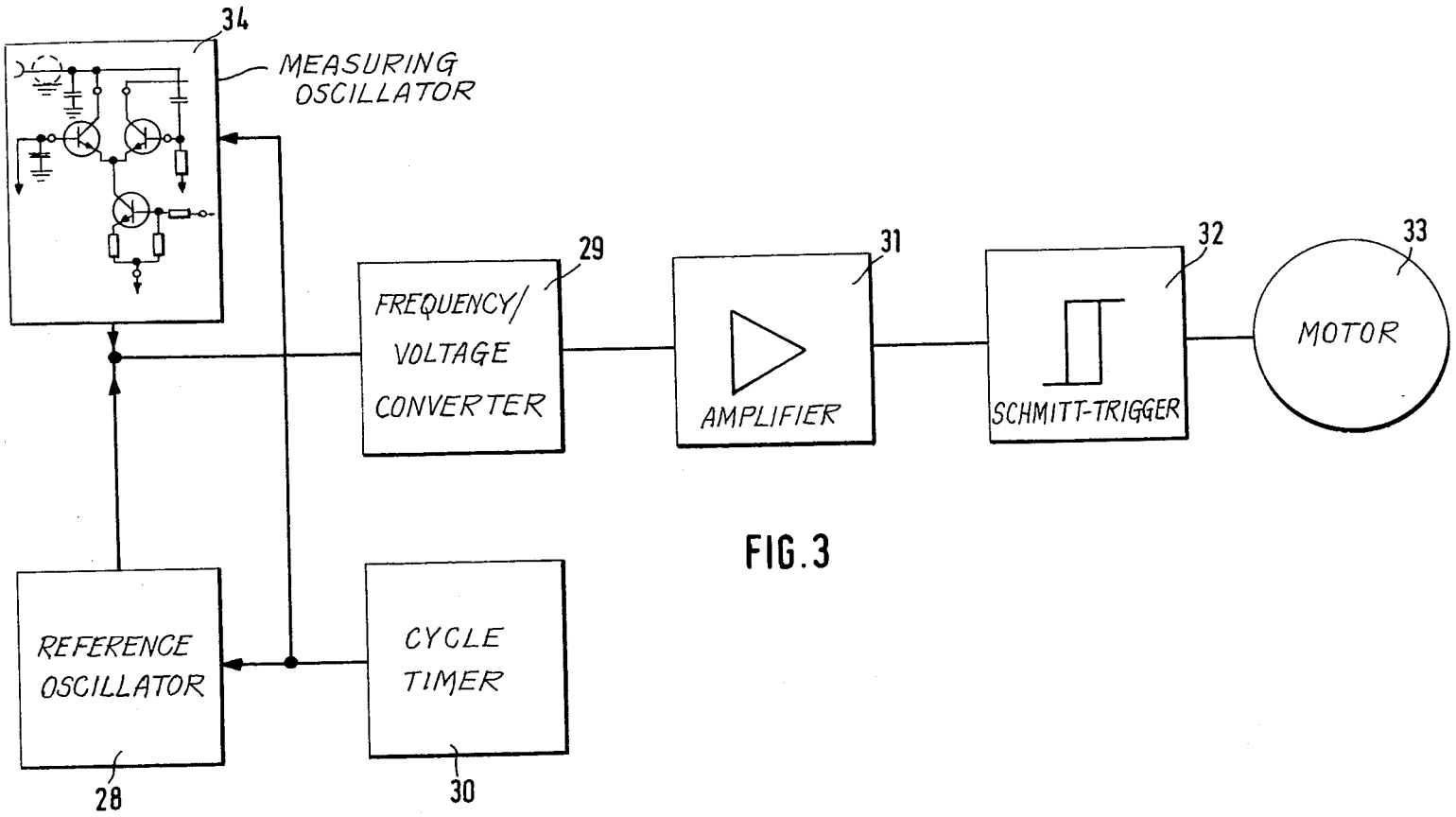

FIG. 3 is a block diagram of the device according to the invention for measuring the concentration of toner in the developer mixture.

DETAILED DESCRIPTION OF PREFERRED EMBODIMENTS

According to the invention, the inductance component has at least one coil which has the shape of a plate and of which all the conductor paths lie in one plane.

The principal advantages achieved by the invention are (1) that the measuring coils used in the measuring device have a very small overall height, so that there are no difficulties in installing them in a copying machine in which, generally, little space is available, and (2) that the stream of developer remains largely undisturbed by the measuring coils, for example, it is not constricted, but nevertheless, a major portion of the developer is sampled.

Figure 1:
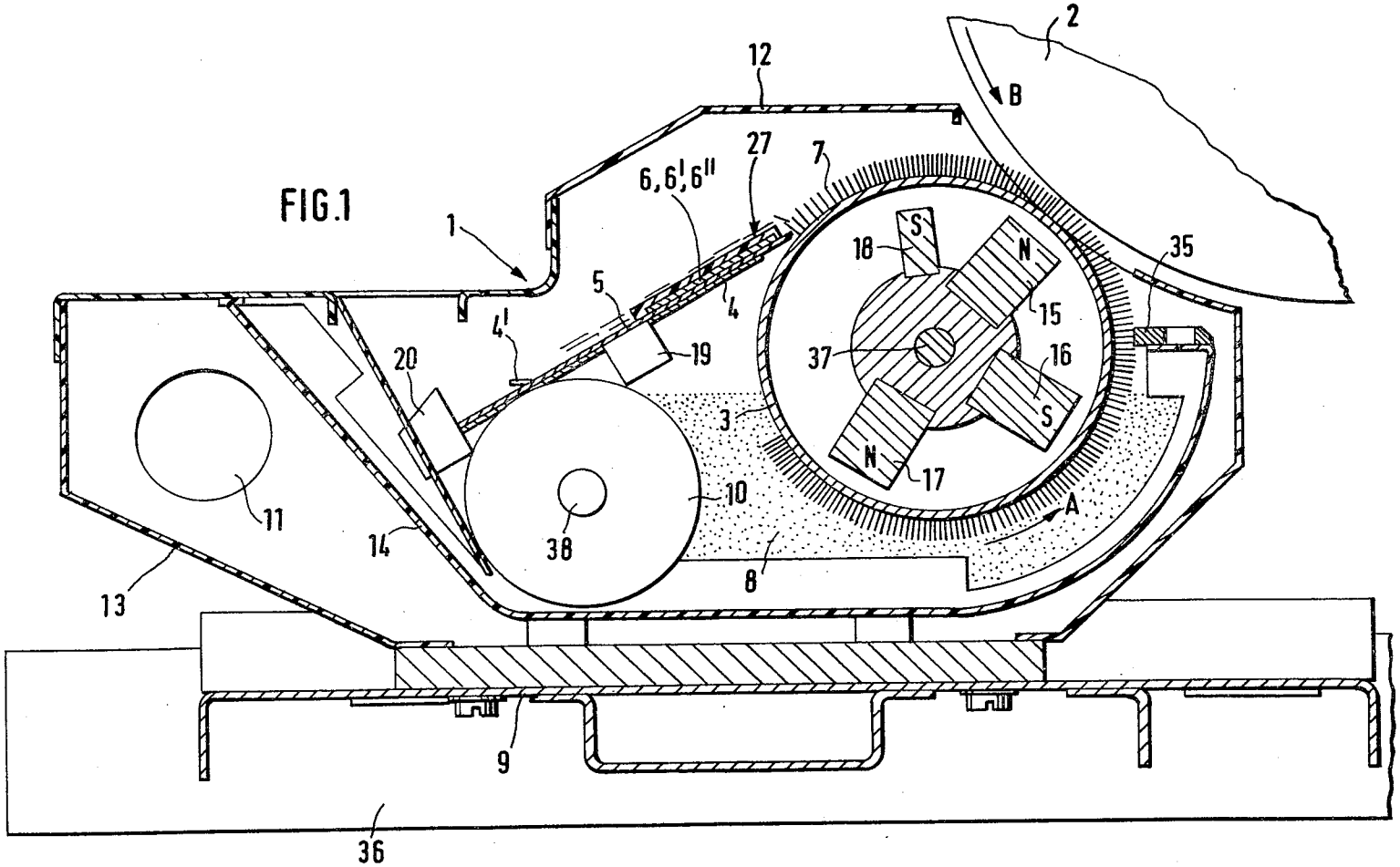
FIG. 1 is a diagrammatic view partly in cross-section of a portion of a copying machine containing an embodiment of the toner concentration measuring device of the present invention.

FIG. 1 of the drawing shows a diagrammatic view of a developing device 1 and a drum 2 of a copying machine. The drum 2 is provided with a photo-conductive surface and rotates, for example, in the direction of the arrow B. During copying, an electrostatic latent image is present on the photo-conductive surface of the drum 2, which latent image is brought into contact with the developer mixture in the developing device 1 in order to develop it into a visible toner image.

The developer mixture 7 is taken by means of a so-called magnetic brush from a developer stock 8 in a developer trough 14 and applied to the surface of the drum 2. The magnetic brush consists of a cylinder 3 which is rotatable about its longitudinal axis 37. In the interior of the cylinder 3, several magnets 15, 16, 17 and 18 are arranged radially; of these, for example, the magnets 16 and 17 are used to deliver the developer mixture 7 and the magnet 15 is used for applying the developer mixture 7 to the drum 2. Approximately one half of the cylinder 3 is immersed in the developer stock 8, whereby the developer mixture consisting of toner particles and carrier particles is attracted to the surface of the cylinder 3, adjacent to the magnets 16 and 17, and is delivered by the roation of the cylinder 3 for the development of the latent image on the surface of the drum 2. Under the influence of the magnetic field of the magnets 15 to 18, the ferromagnetic carrier particles align themselves in the direction of the lines of force of the magnetic field and form, together with the toner, a brush-like covering of developer mixture (shown at 7) on the surface of the cylinder 3. A scraper blade 35 is fixed to the right-hand closure edge of the developer trough 14 at a preset distance from the surface of the cylinder 3, in order to limit the thickness of this covering. The magnets 15 to 18 preferably are bar magnets, wherein the poles, which lie close to the inside of the cylinder shell, have alternating polarities. The purpose of the magnet 18 is still to maintain the developer mixture 7 in alignment like a magnetic brush even after the contact between the cylinder 3 and the drum 2.

The developing device 1 is mounted on a support frame 9 which is located on a console 36. A cover 12 closes the top of the developing device 1. Near the base of the developer trough 14, a mixer shaft 10 is provided which rotates about its longitudinal axis 38 and effects appropriate thorough mixing of the developer stock 8 in the developer trough 14. An exhaust or vacuum housing 13 of an exhaust device 11 is connected in integral construction with the developing device 1; this exhaust device is adjacent to the developer trough 14 and ensures that developer mixture which is in free suspension outside the developer trough 14, is withdrawn.

The developer mixture 7 which has not been applied to the surface of the drum 2 passes onto a deflection plate 4 which runs obliquely and tangentially to the surface of the cylinder 3. The deflection plate 4 is mounted on a fixture support 19 and can, for example across its width, i.e., perpendicular to the plane of the drawing, have the shape of saw teeth, and the tips of the saw teeth 4' can be bent upwardly. The developer mixture 7 trickles back over the deflection plate 4 into the developer trough 14 returning to the developer stock 8. In the upper part of the deflection plate, close to the cylinder 3 of the magnetic brush, a component 5 is located which at least partially consists of a plate-shaped coil 6. The lower end of the deflection plate 4 bears against a further fixture support 20, to which the lateral edges of the deflection plate 4 are fastened (not illustrated).

The component 5, with its inductance provided by the coil 6, is part of a circuit for detecting changes in the inductance of the coil 6 as a function of changes in the concentration of toner in the developer mixture 7. The circuit also generates signals for acturating a toner feed device, which is not shown.

The component 5 is arranged in such a way that at least a part of the developer mixture 7 which trickles over the deflection plate 4 into the developer trough 14, passes into the zone of the magnetic lines of force of the coil 6.

The embodiment of the component 5 shown in FIG. *2a* comprises the single coil 6 which extends in the form of a rectangle over the length of the component 5 up to the vicinity of the edges which are predetermined by the narrow sides of the component 5. The component 5 with the coil 6 has the shape of a plate on which the conductor paths 22 of the coil 6 are obtained by etching the surface of an electrically conductive plate. This can be effected, for example, in a known manner by coating the plate with a light-sensitive layer onto which a negative image of the coil is copied. Subsequently, the image is developed and etching is carried out. The result is a relief etching, that is to say, the coil appears to be raised. Instead of a plate, it is of course also possible to use a metal foil, thin metal sheet or the like for making the coil 6, which is then subsequently joined to the component 5.

A conductor path 22 having mutually perpendicular lateral edges 24, 25 leads outwardly like a helix starting from a central part 23 of the coil 6. The lengths of the lateral edges 24, 25 increase in the outer portion of the helical-like configuration. In general, the component 5 has a length which corresponds to at least the total width of the deflection plate 4.

The electrical connection of the coil 6 is made on one side at the outer end of the conductor path 22 and on the other side at a so-called feed-through point (which is not shown) in the central part 23.

Figure 2A:
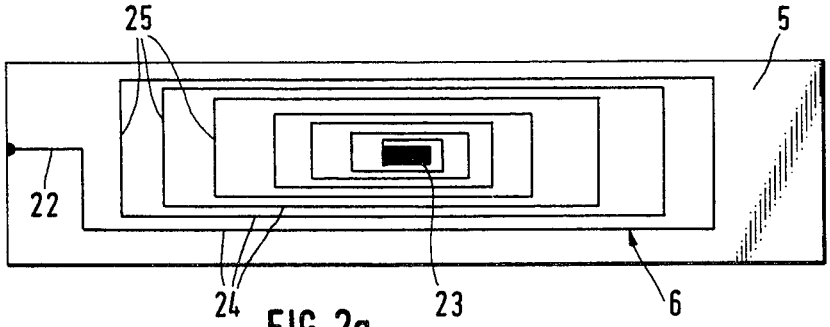
Figure 2B:
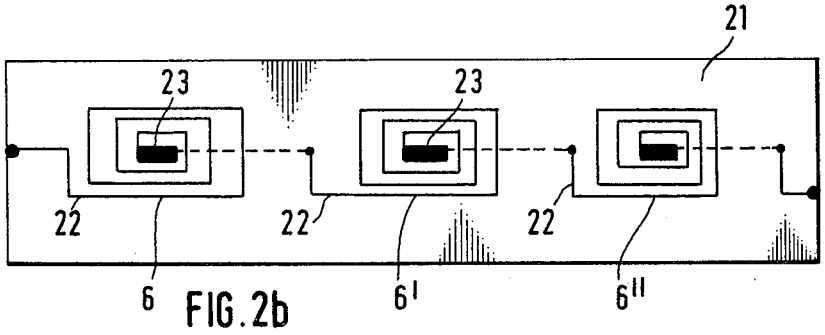

The embodiment shown in FIG. 2*b* is of an alternative component 21, which has, in addition to the coil 6, a plurality of additional plate-shaped coils 6', 6'', . . . which are electrically connected to one another in series. These plate-shaped coils 6, 6'6'' again extend over almost the entire length of the component 21 and hence over the entire width of the deflection plate 4. The design of the individual coils 6, 6', 6'', . . . is similar to that of the above-described coil 6 of the component 5. The conductor paths 22 of these coils have the form of open rectangles, with each of the individual conductor paths starting from a central part 23 of each coil 6, 6' or 6'', . . . and comprising lateral edges 24, 25 which increase in length in the outer portion of the helical-like configuration. The connection of the individual coils 6, 6' or 6',6'' from the feed-through point, which is not shown in the central part 23 of the individual coil to the next adjacent coil is illustrated by dashed lines.

Figure 2C:
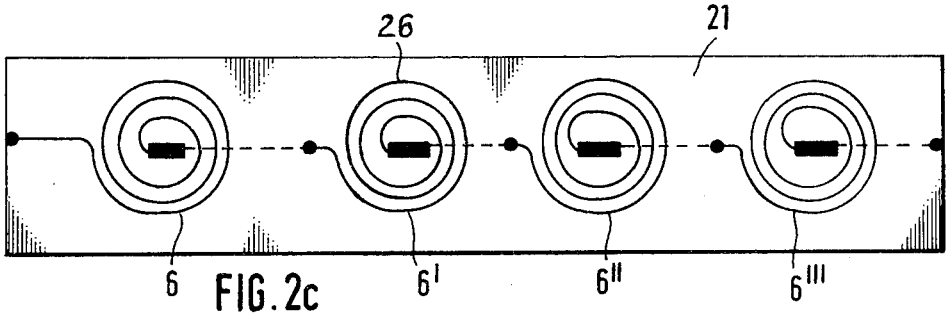

FIG. 2*c* shows a further embodiment of the component 21 which consists of a plurality of plate-shaped coils 6,6', 6'', . . . the conductor paths 26 of which run helically from the inside out. These coils are likewise electrically connected to one another in series, as shown by the dashed lines.

It is obvious to those skilled in the art that the conductor paths of the individual coils can also be arranged in other ways which differ from those in the preferred embodiments illustrated and that the individual coils can also be manufactured by different etching processes or other processes, such as, for example, electroplating the conductor paths onto the component 5 or 21.

Figure 2D:
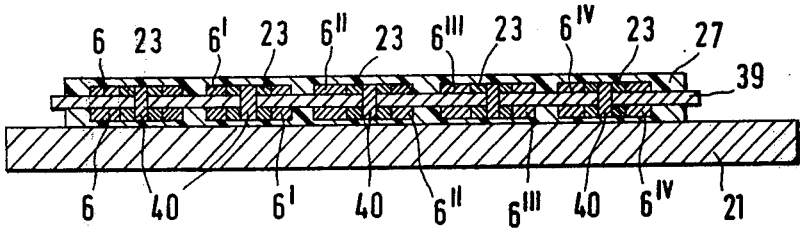

To avoid an electrically conductive contact between the developer mixture 7 and the conductor paths 22 or 26 of the plate-shaped coils 6,6',6'' of the components 5 or 21, respectively, the latter are advantageously potted with an electrically insulating transparent material 27 (FIG. 2*d*).

FIG. 2*d* shows a fruther embodiment of the component 5 or 21 which has an inductance comprised of a plurality of plate-shaped coils 6,6'6'', . . . which are shown diagrammatically in the drawing. The shape of an individual coil corresponds to one of the forms of coils described by reference to FIGS. 2*a* to 2*b*.

Figure 2E:
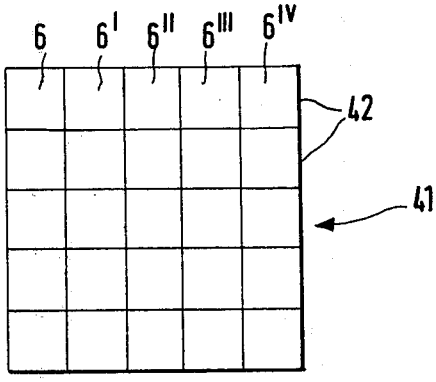

The coils are located on both sides of a strip 39 and are geometrically adjacent to one another on each side. To avoid an electrically conductive contact between the developer mixture 7 and the coils, the latter are enclosed by a layer of electrically insulating, transparent material 27. The strip 39 consists, for example, of a plastic film which is coated on both sides with copper. As already described above, the individual coils are etched out of the copper layer on each side of the strip 39. The central part 23 of each of the coils 6,6',6'', . . . is electrically connected via a feed-through point 40 to the corresponding opposite coil 6,6',6'', . . . on the other side of the strip 39. As indicated diagrammatically in FIG. 2*e*, the coils 6,6',6'', . . . are interconnected in a matrix 41 in such a way that the coils in an individual line 42 of the matrix 41 are electrically connected to one another in series. The parallel rows of the matrix 41, however, are electrically connected to one another in parallel. If this is, for example, a square matrix, the total inductance of the matrix equals the inductance of the individual coil 6,6',6'' and so on. In practice, a matrix comprising 25 coils which are arranged in 5 rows of 5 coils each, has proved suitable. Of course, it is also possible to select a matrix which is not square but rectangular. Furthermore, the most diverse combinations of series connections and parallel connections within the matrix are conceivable, The coils are arranged geometrically adjacent to one another on each side of the strip 39, independent of the particular selected electrical interconnection of the coils to one another to give a certain matrix.

FIG. 3 shows a block diagram of the device for measuring the concentration of toner in the developer mixture 7. The component 5 or 21 is part of a measuring oscillator 34 which is connected to a reference oscillator 28. The two oscillators are triggered by a cycle timer 30 which switches either the measuring oscillator 34 or the reference oscillator 28 so that only the output frequency of one of the two oscillators is at any time applied to a frequency/voltage converter 29. The output voltage of the converter 29 is appropriately amplified in an amplifier 31 and triggers a Schmitt trigger stage 32. The latter is adjusted so that a motor 33, connected thereto, is switched on when it is necessary to replenish the developer mixture by the addition of more toner, and is switched off when the developer mixture has the desired concentration of toner. The motor 33 actuates a toner feed device which is not shown.

The circuit design of the measuring oscillator 34 is in itself known and comprises an oscillating circuit which is formed by a capacitor and the inductance of the component 5 or 21. This oscillating circuit is located in the collector path of a transistor, the base of which is connected to a voltage source. The transisitor is a component of an oscillator circuit, which includes a further transistor. The emitters of the two transistors are connected to the collector of a further transistor, which operates as a switching transistor and which is opened or closed by the cycle timer 30.

Any change in the leakage inductance of the individual coil 6 or the combination of coils 6,6',6'' . . . of the component 5 or 21 changes the frequency of the measuring oscillator 34. The output frequency of the measuring oscillator 34 is compared with the fixed output frequency of the reference oscillator 28. In general, the setting is such that, when the concentration of toner in the developer mixture falls, the resonant frequency of the measuring oscillator 34 increases and the upward deviation of this frequency from the fixed reference frequency of the reference oscillator 28 rises accordingly. Corresponding to the selected gain of the amplifier 31 and the triggering voltage for the Schmitt trigger stage 32, the motor 33 is then starting up. As long as the output frequency of the measuring oscillator 34 is below the value of the fixed frequency of the reference oscillator 28, the Schmitt trigger stage 32 does not respond and the motor 33 is at rest, so that no toner is fed to the developer mixture.

What is claimed is:

1. A device for measuring the concentration of toner in a developer mixture composed of toner and a ferromagnetic carrier material, said device being adapted for installation in an electrophotographic developing device and comprising: a measuring oscillator which comprises an inductance-including component comprising a plurality of coils electrically connected to one another, wherein said coils are located on both sides and adjacent to one another on each side of a strip of insulating material which is part of the inductance-including member, said inductanc including member being separated from said developer by an electrically insulating material;

means for passing all of the developer mixture which is not applied to a drum into the zone of inductance, said means includes a cylinder for applying the developer mixture to a photoconductive surface of said drum mounted above the cylinder, said insulating material rests upon a deflection plate extending tangentially to said cylinder and at an angle with a horizontal; and means for evaluating changes in the frequency of said oscillator resulting from changes in the developer mixture composition passing over the zone of inductance.

2. In an electrophotographic developing device having a developer container, said container storing a quantity of developer which comprises a mixture of toner and ferromagnetic carrier material, said device further including a means for applying said developer to the drum of said device and a deflection plate for removing developer which is not applied to said drum from said means, an improvement in a device for measuring the concentration of toner in said mixture, said improvement comprising:

a measuring oscillator which comprises an inductance-including component comprising at least one coil having a zone of inductance, said inductance-including member being separated from said developer by an electrically insulating material;

said at least one coil lies substantially in one plane;

means for passing substantially all of said developer which is not applied to said drum into the zone of inductance; and means for evaluating changes in the frequency of oscillator resulting from changes in the developer composition passing into the zone of inductance.

3. The device as claimed in claim 1, wherein the coils extend over the entire width of the deflection plate.

4. The device as claimed in claim 1, 2 or 3, wherein the conductor paths of each coil comprise the form of rectangular-shaped helix.

5. The device as claimed in claim 1, 2 or 3, wherein the conductor paths of each coil comprise the shape of a spiral.

6. The device as claimed in claim 1 or 2, wherein the central part of each coil on one side of said strip is electrically connected to the opposite coil on the other side of the strip.

7. The device as claimed in claim 1 or 2, wherein the coils are interconnected in a matrix in such a way that the coils in each line of the matrix are electrically connected in series and the rows of the matrix are electrically connected in parallel to one another.

8. The device as claimed in claim 7, wherein the total inductance of the matrix is equal to the inductance of an individual coil.

9. An electro-photographic copying apparatus, comprising a compartment containing a developer mixture comprised of a toner and a ferromagnetic carrier material, the toner concentration measuring device as defined in claim 1 positioned in said compartment, and means for replenishing toner to the developer mixture in response to a signal emitted by said measuring device.

10. The device as claimed in claim 1, wherein said coils are electrically connected to one another in series.

* * * * *